US008552291B2

(12) United States Patent
Lingambudi et al.

(10) Patent No.: US 8,552,291 B2
(45) Date of Patent: Oct. 8, 2013

(54) CABLE FOR HIGH SPEED DATA COMMUNICATIONS

(75) Inventors: Anil B. Lingambudi, Bangalore (IN); Bhyrav M. Mutnury, Austin, TX (US); Nam H. Pham, Austin, TX (US); Saravanan Sethuraman, Business Park (IN)

(73) Assignee: International Business Machines Corporation, Armonk, NY (US)

( * ) Notice: Subject to any disclaimer, the term of this patent is extended or adjusted under 35 U.S.C. 154(b) by 268 days.

(21) Appl. No.: 12/786,673

(22) Filed: May 25, 2010

(65) Prior Publication Data

US 2011/0290524 A1 Dec. 1, 2011

(51) Int. Cl.
*H01B 11/02* (2006.01)

(52) U.S. Cl.
USPC .. 174/36; 174/110 R; 174/113 R; 174/117 R; 174/117 F

(58) Field of Classification Search
USPC ..... 174/36, 103, 102 R, 102 SP, 113 R, 174/117 R, 117 F, 117 FF
See application file for complete search history.

(56) References Cited

U.S. PATENT DOCUMENTS

| | | | | | |
|---|---|---|---|---|---|
| 4,323,721 | A * | 4/1982 | Kincaid et al. | ..... | 174/36 |
| 4,860,343 | A * | 8/1989 | Zetena, Jr. | ..... | 379/110.01 |
| 5,144,098 | A * | 9/1992 | VanDeusen | ..... | 174/36 |
| 5,416,268 | A * | 5/1995 | Ellis | ..... | 174/36 |
| 5,473,336 | A | 12/1995 | Harman et al. | | |
| 5,483,020 | A * | 1/1996 | Hardie et al. | ..... | 174/36 |
| 5,767,442 | A * | 6/1998 | Eisenberg et al. | ..... | 174/36 |
| 6,403,887 | B1 * | 6/2002 | Kebabjian et al. | ..... | 174/110 R |
| 6,444,902 | B1 * | 9/2002 | Tsao et al. | ..... | 174/36 |
| 6,677,518 | B2 * | 1/2004 | Hirakawa et al. | ..... | 174/36 |
| 6,803,518 | B2 * | 10/2004 | Chang | ..... | 174/36 |
| 6,849,799 | B2 | 2/2005 | Springer et al. | | |
| 7,479,601 | B1 * | 1/2009 | Cases et al. | ..... | 174/102 R |
| 7,531,749 | B2 | 5/2009 | Archambeault et al. | | |
| 2006/0254805 | A1 | 11/2006 | Scherer et al. | | |

* cited by examiner

*Primary Examiner* — William H Mayo, III

(74) *Attorney, Agent, or Firm* — H. Barrett Spraggins; Cynthia G. Seal; Biggers & Ohanian, LLP

(57) ABSTRACT

A cable for high speed data communications that includes a first inner conductor enclosed by a first dielectric layer and a second inner conductor enclosed by a second dielectric layer. The inner conductors and the dielectric layers are disposed within the cable in parallel with a longitudinal axis of the cable. The cable also includes drain conductors disposed within the cable laterally to the inner conductors adjacent to the dielectric layers along the longitudinal axis of the cable and within thirty degrees of a horizontal axis through the inner conductors. The cable also includes a conductive shield composed of a strip of conductive shield material wrapped in a rotational direction along and about the longitudinal axis around the inner conductors, the dielectric layers, and the drain conductors.

12 Claims, 7 Drawing Sheets

PRIOR ART FIG. 2

CABLE FOR HIGH SPEED DATA COMMUNICATIONS

BACKGROUND OF THE INVENTION

1. Field of the Invention

The field of the invention is data processing, or, more specifically, methods and apparatus for cables for high speed data communications.

2. Description of Related Art

High speed data communications over shielded cables are an important component to large high-end servers and digital communications systems. While optical cables provide long distance drive capability, copper cables are typically preferred in environments that require a shorter distance cable due to a significant cost savings opportunity. A typical copper cable used in environments requiring a shorter distance cable, is a twinaxial cable. A twinaxial cable is a coaxial cable that includes two insulated, inner conductors and a shield wrapped around the insulated inner conductors. Twinaxial cables are used for half-duplex, balanced transmission, high-speed data communications. In current art however, twinaxial cables used in data communications environments are limited in performance due to a bandstop effect. That is, typical twinaxial cables for high speed data communications have certain drawbacks. Typical twinaxial cables have a bandstop filter created by overlapped wraps of a shield that attenuates signals at frequencies in a stopband. The attenuation of the signal increases as the length of the cable increases. The attenuation limits data communications at frequencies in the stopband.

Signal attenuation is becoming more and more important with the ever increasing need for high-speed transmission. Signal attenuation in cables can result from number of factors such as dielectric loss, skin effect, conductor loss, and radiation. In high-speed shielded cables, skin effect is a major contributor for attenuation at high frequencies. The results of skin effect at high frequency can be predicted, but the loss due to improper current return path is a major bottle neck in high speed shielded cables. In twinaxial cable, a wrapped foil shield typically provides a current return path for a high speed, alternating current signal, and there is a current return path discontinuity at every overlap of the shielding foil. Each such discontinuity contributes to an overall impedance mismatch and signal loss.

SUMMARY OF THE INVENTION

A cable for high speed data communications that includes a first inner conductor enclosed by a first dielectric layer and a second inner conductor enclosed by a second dielectric layer, the inner conductors and the dielectric layers disposed within the cable in parallel with a longitudinal axis of the cable; drain conductors disposed within the cable laterally to the inner conductors adjacent to the dielectric layers along the longitudinal axis of the cable and within thirty degrees of a horizontal axis through the inner conductors; and a conductive shield composed of a strip of conductive shield material wrapped in a rotational direction along and about the longitudinal axis around the inner conductors, the dielectric layers, and the drain conductors, including overlapped wraps of the conductive shield material along the longitudinal axis.

The foregoing and other objects, features and advantages of the invention will be apparent from the following more particular descriptions of exemplary embodiments of the invention as illustrated in the accompanying drawings wherein like reference numbers generally represent like parts of exemplary embodiments of the invention.

DETAILED DESCRIPTION OF EXAMPLE EMBODIMENTS

Figure 1:
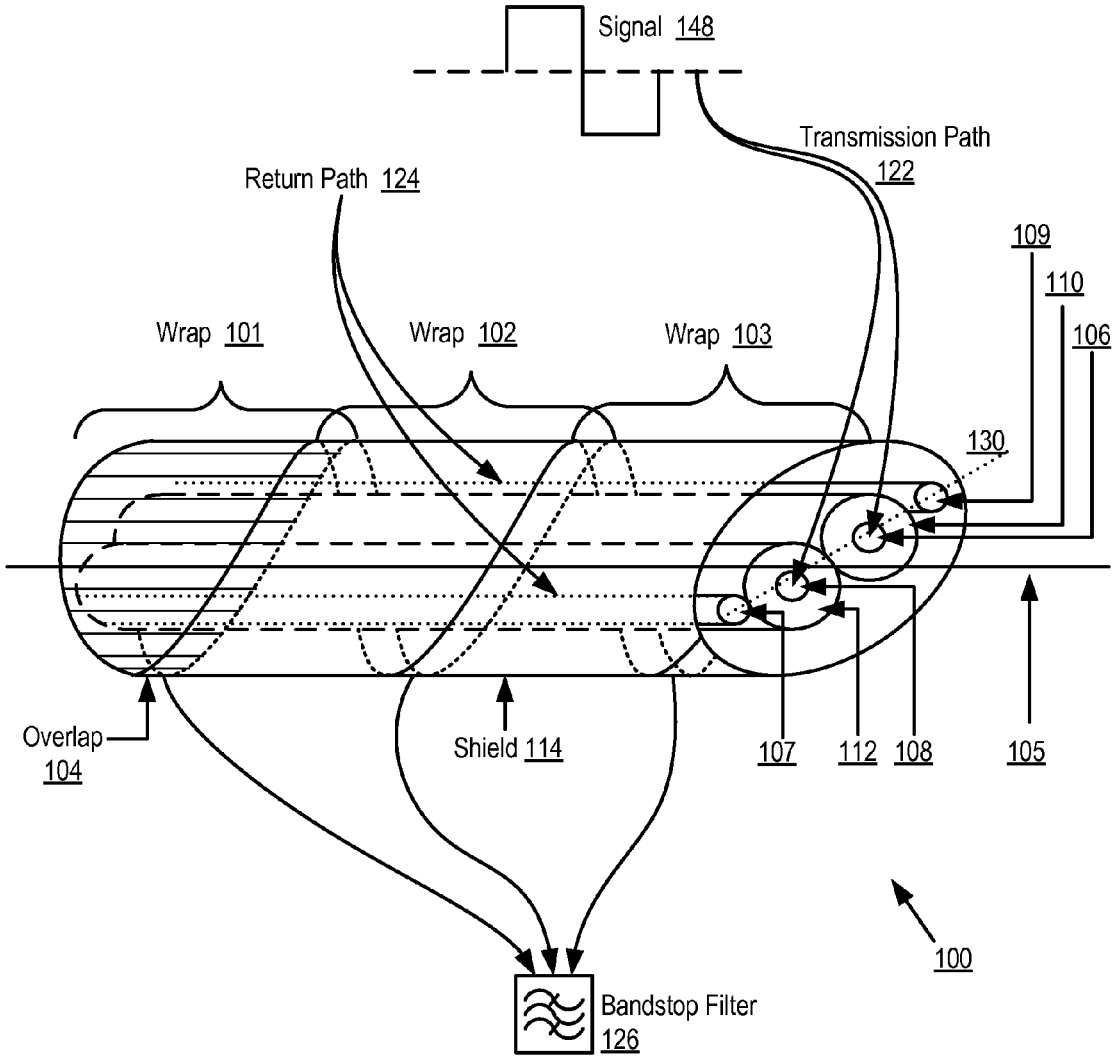
FIG. 1 sets forth a perspective view of an example twinaxial cable (100) according to embodiments of the present invention.

Example methods and apparatus for cables for high speed data communications in accordance with the present invention are described with reference to the accompanying drawings, beginning with FIG. 1. FIG. 1 sets forth a perspective view of an example twinaxial cable (100) according to embodiments of the present invention. The example twinaxial cable (100) of FIG. 1 includes two inner conductors (106, 108) and two dielectric layers (110, 112) surrounding the inner conductors. The inner conductors (106, 108) and the dielectric layers (110, 112) are disposed within the cable in parallel with a longitudinal axis (105) of the cable and, therefore, in parallel with one another.

The example cable (100) of FIG. 1 includes two drain conductors (107, 109) disposed within the cable laterally to the inner conductors (106, 108) adjacent to the dielectric layers (110, 112) along the longitudinal axis (105) of the cable and within thirty degrees of a horizontal axis (130) through the inner conductors. The term 'lateral' or 'laterally' is used to refer to the area of the cable outside of the inner conductors and the dielectric layers—as opposed to the space between the inner conductors or between the dielectric layers, which would be referred to as a 'medial' disposition within the cable or a disposition 'medially' to the inner conductors. That the drain conductors are disposed within thirty degrees of a horizontal axis through the inner conductors is illustrated here by the fact that the drain conductors are disposed approximately upon a horizontal axis (130) through the inner conductors. That the drain conductors are disposed within thirty degrees of a horizontal axis through the inner conductors is explained in more detail below with reference to FIG. 3.

The example cable (100) of FIG. 1 also includes a conductive shield (114). The shield, when wrapped around the conductors of a cable, acts as a Faraday cage to reduce electrical noise from affecting signals transmitted on the cable and to reduce electromagnetic radiation from the cable that may interfere with other electrical devices. The shield also minimizes capacitively coupled noise from other electrical sources, such as nearby cables carrying electrical signals. The shield (114) is wrapped around the conductors (106, 108). The shield is composed of a strip of conductive shield material wrapped in a rotational direction along and about the longitudinal axis (105) around the inner conductors (106, 108), the dielectric layers (110, 112), and the drain conductors (107, 108). The shield includes overlapped wraps (104, 101, 102, 104) of the conductive shield material along the longitudinal axis of the cable. The shield (114) is conductive, and it is insulated from the inner conductors (106, 108) by the dielectric layers (110, 112). The shield (104), however, is in direct electrical contact with the drain conductors (107, 109) throughout the length of the cable.

The shield (114) includes wraps (101-103) along and about the longitudinal axis (105), each wrap overlapping (104) the previous wrap. A wrap is a 360 degree turn of the shield around the longitudinal axis (105). The example cable of FIG. 1 includes three wraps (101-103), but readers will recognize that the shield may be wrapped around the inner conductors and the dielectric layers any number of times in dependence upon the length of the cable. Wrap (101) is shaded for purposes of explanation. Each wrap (101-103) overlaps the previous wrap. That is, wrap (101) is overlapped by wrap (102) and wrap (102) is overlapped by wrap (103). The overlap (104) created by the overlapped wraps is continuous along and about the longitudinal axis (105) of the cable (100).

The wraps (101-103) of the shield (114) create an overlap (104) of the shield that forms an electromagnetic bandgap structure ('EBG structure') that acts as a bandstop filter. An EBG structure is a periodic structure in which propagation of electromagnetic waves is not allowed within a stopband. A stopband is a range of frequencies in which a cable attenuates a signal. In the cable of FIG. 1, when the conductors (106, 108) carry an alternating current signal (148) from a source to a load, part of the current is returned on the shield (114). Due to skin effect, the current in the conductors in a transmission path (122) to a load displaces on the outer surface of the conductor, and the current return path (124) attempts to run parallel to, but in the opposite direction of, the current to the load. As such, the current on the shield (114) encounters the overlap (104) of the shield (104) periodically and a discontinuity exists in the current return path due to the overlap. The discontinuity in the current return path at the overlap (104) created by the wraps (101-103) acts as a bandstop filter that attenuates signals at frequencies in a stopband.

Figure 2:
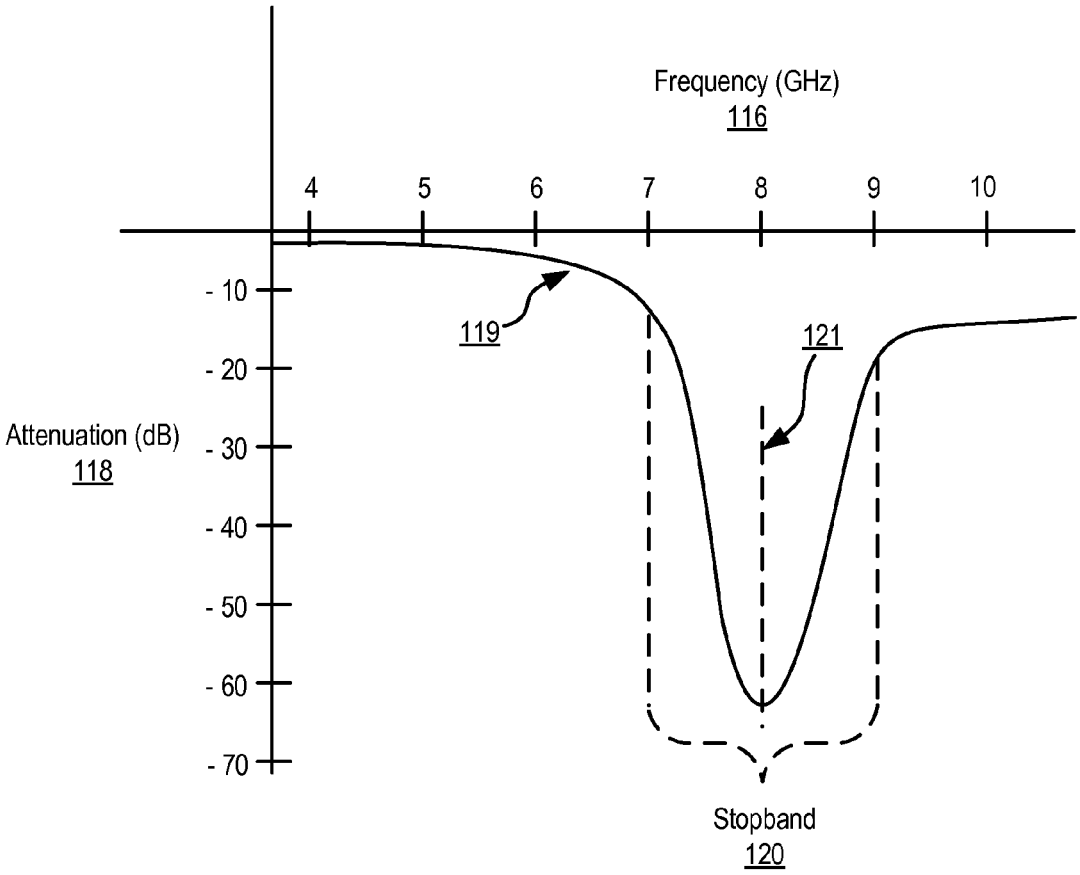
FIG. 2 sets forth a graph of the insertion loss of a typical prior-art twinaxial cable.

For further explanation, FIG. 2 sets forth a graph of the insertion loss of a typical prior-art twinaxial cable. Insertion loss is the signal loss in a cable that results from inserting the cable between a source and a load and driving the signal from the source to the load through the cable. The insertion loss depicted in the graph of FIG. 2 is the insertion loss of a typical twinaxial cable. In the graph of FIG. 2, the signal (119) is attenuated (118) within a stopband (120) of frequencies (116) ranging from seven to nine gigahertz ('GHz'). The stopband (120) has a center frequency (121) that varies in dependence upon the composition of the shield, the width of the shield, and the rate that the shield is wrapped around the conductors and dielectrics. The center frequency (121) of FIG. 2 is 8 GHz.

The attenuation (118) of the signal (119) in FIG. 2 peaks at approximately −60 decibels ('dB') for signals with frequencies (116) in the range of approximately 8 GHz. The magnitude of the attenuation (118) of the signal (119) is dependent upon the length of the cable. The effect of the EBG structure, the attenuation of a signal, increases as the length of the EBG structure increases. A longer cable having a wrapped shield has a longer EBG structure and, therefore, a greater attenuation on a signal than a shorter cable having a shield wrapped at the same rate. That is, the longer the cable, the greater the attenuation of the signal. In addition to signal attenuation, the bandstop effect also increases other parasitic effects in the cable, such as jitter and the like. The illustration of FIG. 2 is said to be prior art because, in cables structured according to embodiments of the present invention, the stopband attenuation is greatly reduced or even eliminated entirely.

Again with reference to FIG. 1: In the example cable (100) of FIG. 1, the current return path discontinuity represented by the overlapping wraps of the conductive shield material is mitigated, attenuated or eliminated entirely, so that shielded twinax cables according to embodiments of the present invention can transmit signals at high frequencies without affecting the quality of the signal. In such cables, drain conductors (107, 109), multiple neutral conductors are placed on the sides of the inner conductors (106, 108) and their dielectric layers (110, 112), strategically placed with thirty degrees of a horizontal axis through the inner conductors so as to provide a continuous and uniform current return path (124) for the current transmitted through the inner conductors. Since the drain conductors provide a uniform current return path for the heavy charge distribution region within thirty degrees of the horizontal axis, a regular conventional conductive shielded foil can be used to wrap the conductors as it is done typically.

In the example cable of FIG. 1, the overlapped wraps (101, 102, 103) of the conductive shield (114) create a bandstop filter (126) that attenuates signals at frequencies in a stopband. Such a stopband typically has a center frequency in the range of 5-10 gigahertz. The drain conductors (107, 109) implement uniform current return paths (124) that reduce the attenuation of signals having frequencies in the stopband. The drain conductors (107, 109) provide a uniform characteristic impedance without disruption throughout the entire length of the cable, circumventing an otherwise disruptive effect of the overlapped wraps of the conductive shield material.

Figure 3:
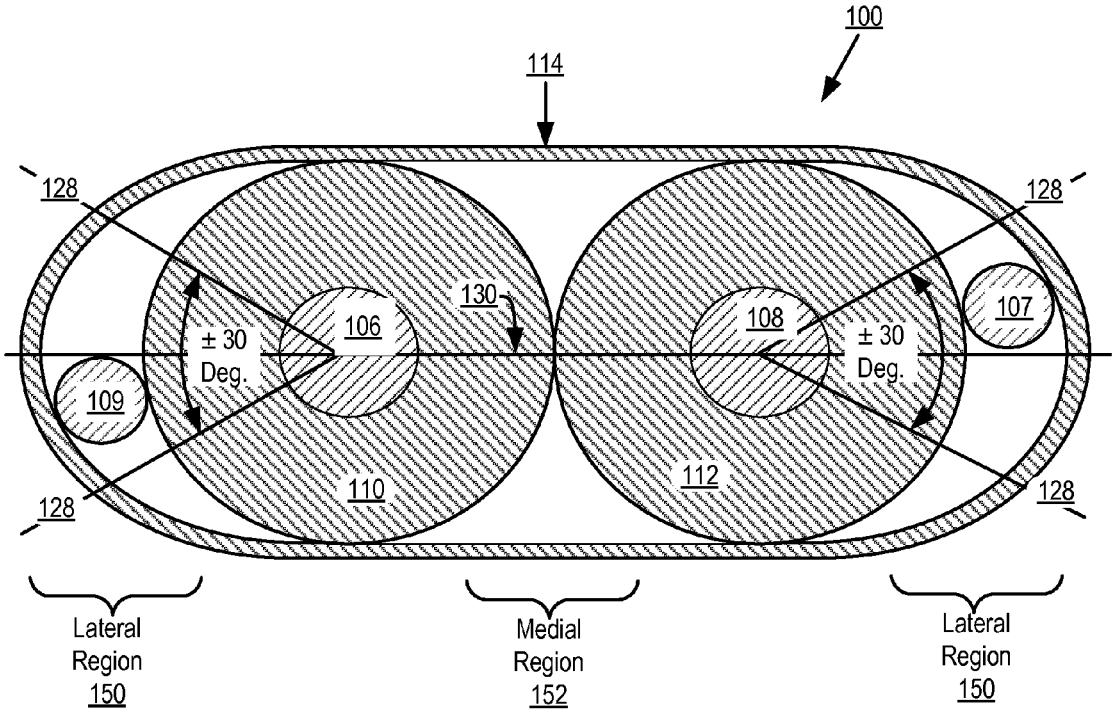
FIG. 3-5 set forth cross sectional views of example cables for high speed data transmission according to embodiments of the present invention.

For further explanation, FIG. 3 sets forth a cross sectional view of an example cable for high speed data transmission according to embodiments of the present invention.

The example twinaxial cable (100) of FIG. 3 includes two inner conductors (106, 108) and two dielectric layers (110, 112) surrounding the inner conductors. The inner conductors (106, 108) and the dielectric layers (110, 112) are disposed within the cable in parallel with a longitudinal axis of the cable and, therefore, in parallel with one another. The example cable (100) of FIG. 3 also includes a conductive shield (114). Like the shield in the cable of FIG. 1, the conductive shield in the example cable of FIG. 3 is also composed of a strip of overlapping wraps of conductive shield material wrapped in a rotational direction along and about the longitudinal axis of the cable around the inner conductors (106, 108), the dielectric layers (110, 112), and the drain conductors (107, 109).

The example cable (100) of FIG. 3 also includes two drain conductors (107, 109) disposed within the cable laterally to the inner conductors (106, 108) adjacent to the dielectric layers (110, 112) along the longitudinal axis of the cable and within thirty degrees of a horizontal axis (130) through the inner conductors. The term 'lateral' or 'laterally' is used to refer to the area (150) of the cable outside of the inner conductors and the dielectric layers—as opposed to the space (152) between the inner conductors or between the dielectric layers, which would be referred to as a 'medial' disposition within the cable or a disposition 'medially' to the inner conductors. Due to skin effect at high frequencies, all or most of the return current flows in the lateral regions of the return path, the lateral (150) portions of the shield (114) and the drain conductors (107, 109). Because the drain (107, 109) provide a uniform characteristic impedance without disruption in the high-current lateral region (150) throughout the entire length of the cable, the drain conductors circumvent an otherwise disruptive effect of the overlapped wraps of the conductive shield material. Most if not all of the return current flows in the uniform impedance of the drain conductors instead of the disruptive path through the lateral section of the shield. Because of skin effect, little or no return current flows in the medial region (152) of the shield.

In the example of FIG. 1, the drain conductors were disposed on the horizontal axis (130) through the inner conductors (106, 108). In the example of FIG. 3, however, the drain conductors (107, 109) are not disposed on the horizontal axis (130). Drain conductor (109) is installed entirely below the horizontal axis, and drain conductor (109) is installed entirely above the horizontal axis (130). In the example of FIG. 3, that the drain conductors are disposed within thirty degrees of a horizontal axis through the inner conductors is illustrated by the drain conductors (107, 109) disposed within angles defined by lines (128) through the centers of the inner conductors (106, 108) and a horizontal axis (130) through the inner conductors, the angles so defined being equal to or less than thirty degrees from the horizontal axis.

Figure 4:
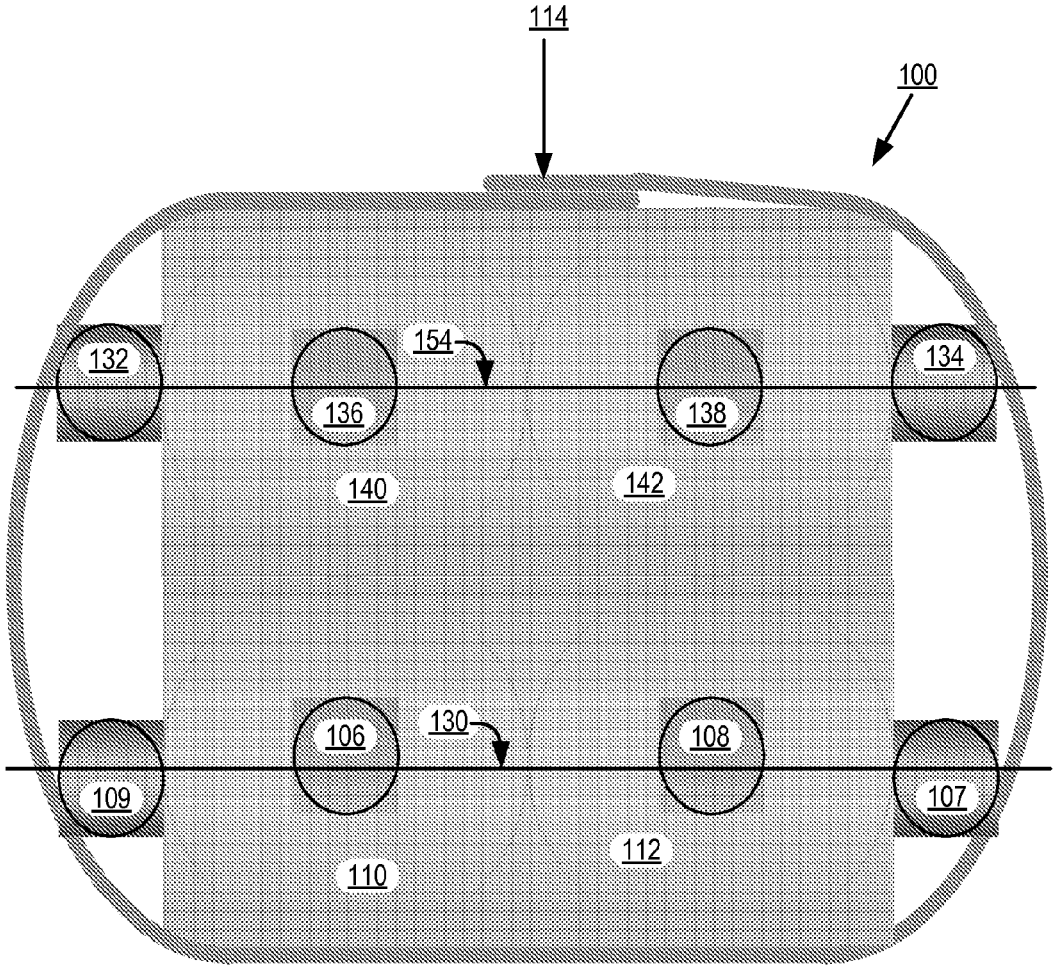

For further explanation, FIG. 4 sets forth a cross sectional view of a further example cable for high speed data transmission according to embodiments of the present invention in which the example cable includes more than two inner conductors. The example cable (100) of FIG. 4 includes two inner conductors (106, 108) and two dielectric layers (110, 112) surrounding the inner conductors with the inner conductors (106, 108) and the dielectric layers (110, 112) are disposed within the cable in parallel with a longitudinal axis of the cable and, therefore, in parallel with one another. The example cable (100) of FIG. 4 also includes two drain conductors (107, 109) disposed within the cable laterally to the inner conductors (106, 108) adjacent to the dielectric layers (110, 112) along the longitudinal axis of the cable and within thirty degrees of a horizontal axis (130) through the inner conductors—in fact, in this example, approximately on the horizontal axis (130).

The example cable (100) of FIG. 4 also includes a third inner conductor (136) enclosed by a third dielectric layer (140) and a fourth inner conductor (138) enclosed by a fourth dielectric layer (142), with the third and fourth inner conductors (136, 138) and the third and fourth dielectric layers (140, 142) stacked upon the first and second inner conductors (106, 108) and the first and second dielectric layers (110, 112) parallel with and along the longitudinal axis of the cable (not shown). The example cable (100) of FIG. 2 also includes drain conductors (132, 134) disposed within the cable laterally to the third and fourth inner conductors (136, 139) adjacent to the third and fourth dielectric layers (140, 142) along the longitudinal axis of the cable and within thirty degrees of a horizontal axis (154) through the third and fourth inner conductors—in fact, in this example, approximately on the horizontal axis (154).

The example cable (100) of FIG. 4 also includes a conductive shield (114). The conductive shield in the example cable of FIG. 4 is composed of a strip of overlapping wraps of conductive shield material wrapped in a rotational direction along and about the longitudinal axis of the cable around all four inner conductors (106, 108, 136, 138), all four dielectric layers (110, 112, 140, 142), and all of the drain conductors (107, 109, 132, 134).

Figure 5:
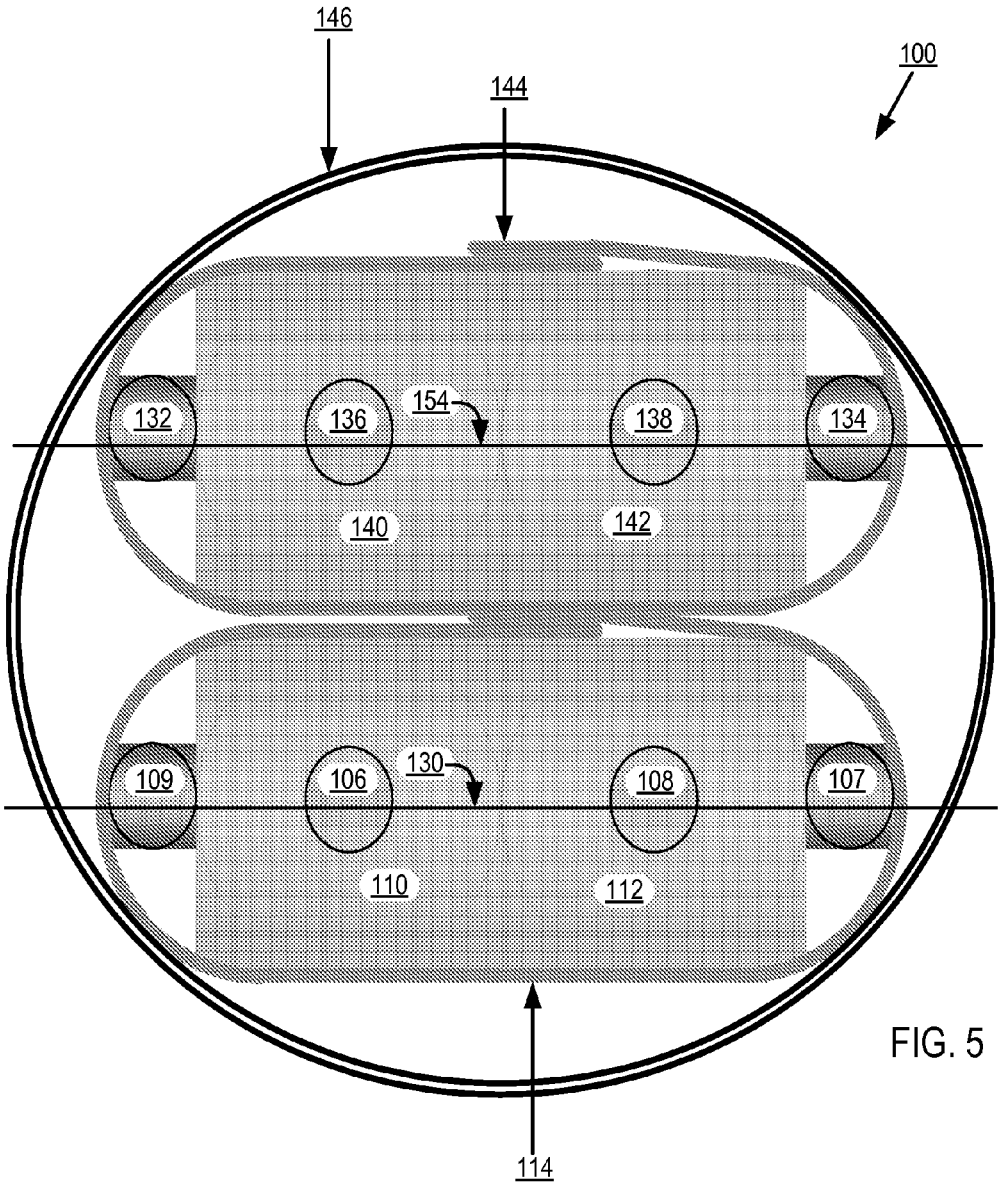

For further explanation, FIG. 5 sets forth a cross sectional view of a further example cable for high speed data transmission according to embodiments of the present invention in which the example cable includes more than two inner conductors. The example cable (100) of FIG. 5 includes two inner conductors (106, 108) and two dielectric layers (110, 112) surrounding the inner conductors with the inner conductors (106, 108) and the dielectric layers (110, 112) are disposed within the cable in parallel with a longitudinal axis of the cable and, therefore, in parallel with one another. The example cable (100) of FIG. 5 also includes two drain conductors (107, 109) disposed within the cable laterally to the inner conductors (106, 108) adjacent to the dielectric layers (110, 112) along the longitudinal axis of the cable and within thirty degrees of a horizontal axis (130) through the inner conductors—in fact, in this example, approximately on the horizontal axis (130). The example cable (100) of FIG. 5 also includes a conductive shield (14) composed of a strip of overlapping wraps of conductive shield material wrapped in a rotational direction along and about the longitudinal axis of the cable around the inner conductors (106, 108), the dielectric layers (110, 112), and the drain conductors (107, 109).

The example cable (100) of FIG. 5 also includes a third inner conductor (136) enclosed by a third dielectric layer (140) and a fourth inner conductor (138) enclosed by a fourth dielectric layer (142), with the third and fourth inner conductors (136, 138) and the third and fourth dielectric layers (140, 142) stacked upon the first and second inner conductors (106, 108) and the first and second dielectric layers (110, 112) parallel with and along the longitudinal axis of the cable (not shown). The example cable (100) of FIG. 2 also includes additional drain conductors (132, 134) disposed within the cable laterally to the third and fourth inner conductors (136, 139) adjacent to the third and fourth dielectric layers (140, 142) along the longitudinal axis of the cable and within thirty degrees of a horizontal axis (154) through the third and fourth inner conductors—in fact, in this example, approximately on the horizontal axis (154). The example cable (100) of FIG. 5 also includes a second conductive shield (144). The second conductive shield is composed of a strip of overlapping wraps of conductive shield material wrapped in a rotational direction along the longitudinal axis of the cable only around the third and fourth inner conductors (136, 138), the third and fourth the dielectric layers (140, 142), and the drain conductors (132, 134) adjacent to the third and fourth dielectric layers. The example cable (100) of FIG. 5 also includes a non-conductive layer (146) enclosing all four inner conductors (106, 108, 136, 138), all four dielectric layers (110, 112, 140, 142), all of the drain conductors (107, 109, 132, 134), and both conductive shields (114, 144).

Figure 6:
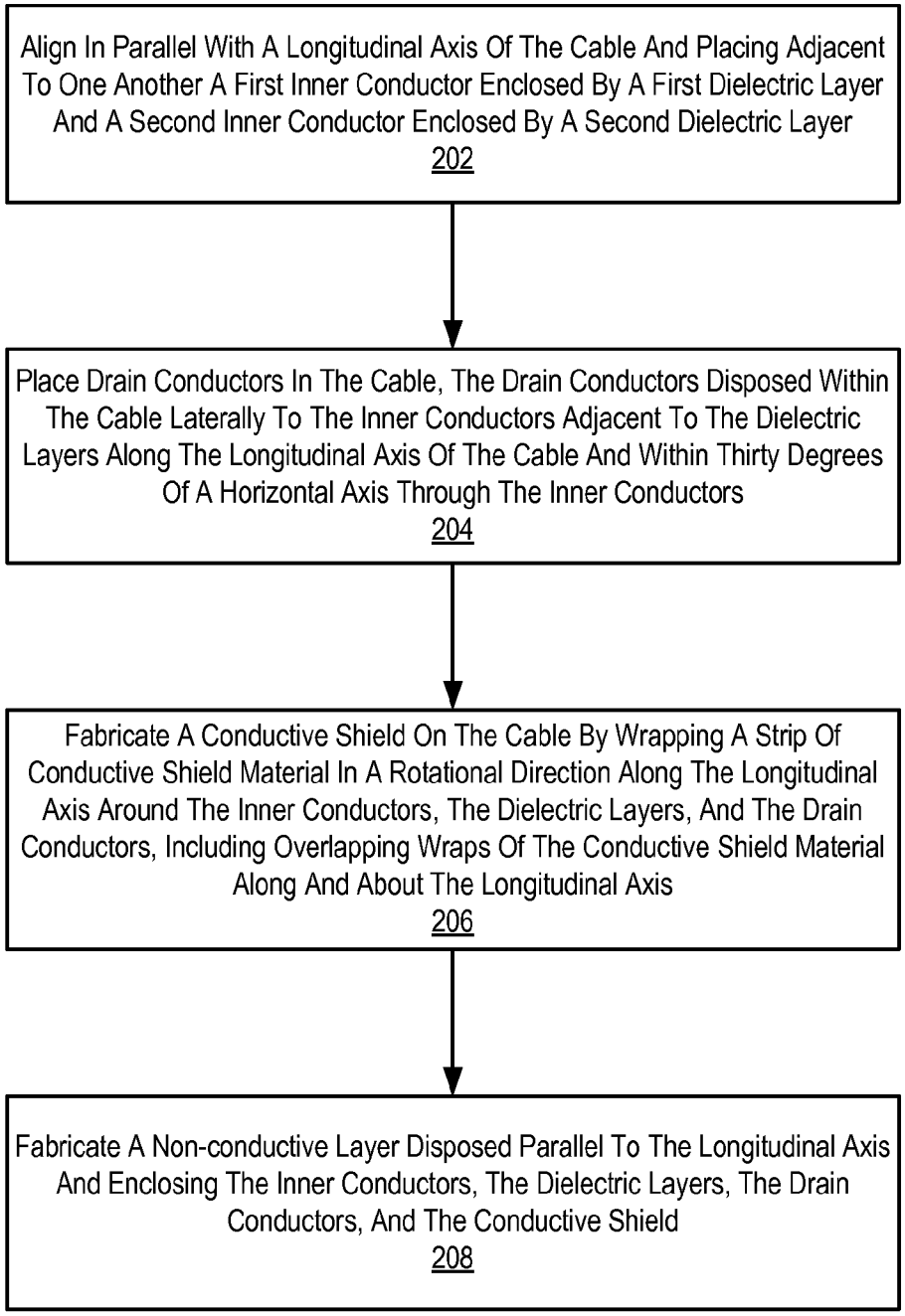
FIG. 6 sets forth a flow chart illustrating an example method of manufacturing a cable for high speed data communications according to embodiments of the present invention.

For further explanation, FIG. 6 sets forth a flow chart illustrating an example method of manufacturing a cable for high speed data communications according to embodiments of the present invention. The method of FIG. 6 manufactures a cable (100) like the one described and illustrated above with reference to FIG. 1, so that FIG. 6 is described with reference not only to FIG. 6 but also to FIG. 1, using reference numbers from both drawings. The method of FIG. 6 includes aligning (202) in parallel with a longitudinal axis (105) of the cable (100) and placing adjacent to one another a first inner conductor (106) enclosed by a first dielectric layer (110) and a second inner conductor (108) enclosed by a second dielectric layer (112).

The method of FIG. 6 also includes placing (204) drain conductors (107, 109) in the cable (100), with the drain conductors disposed within the cable laterally to the inner conductors, adjacent to the dielectric layers along the longitudinal axis of the cable, and within thirty degrees of a horizontal axis (130) through the inner conductors. The overlapped wraps (101, 102, 103) of the conductive shield (114) create a bandstop filter (126) that attenuates signals at frequencies in a stopband. Such a stopband typically has a center frequency in the range of 5-10 gigahertz. The drain conductors (107, 109) implement uniform current return paths (124) that reduce the attenuation of signals having frequencies in the stopband. The drain conductors (107, 109) provide a uniform characteristic impedance without disruption throughout the entire length of the cable, circumventing an otherwise disruptive effect of the overlapped wraps of the conductive shield material.

The method of FIG. 6 also includes fabricating (206) a conductive shield (114) on the cable by wrapping a strip of conductive shield material in a rotational direction along the longitudinal axis (105) around the inner conductors, the dielectric layers, and the drain conductors, so that the conductive shield includes overlapped wraps (101, 102, 103) of the conductive shield material along and about the longitudinal axis. The conductive shield (302) is composed of any conductive material capable of being wrapped around the inner conductors of a cable, typically aluminum foil, but possibly also copper, gold, or other materials as will occur to those of skill in the art.

The method of FIG. 6 also includes an fabricating (208) a non-conductive layer disposed parallel to the longitudinal axis and enclosing the inner conductors (106, 108), the dielectric layers (110, 112), the drain conductors (107, 109), and the conductive shield (114). Such a non-conductive layer, not shown on FIG. 1 but similar to (146) on FIG. 5, protects from physical damage the interior structure of the cable in which the conductive shield, often composed of aluminum foil, can be relatively delicate.

Figure 7:
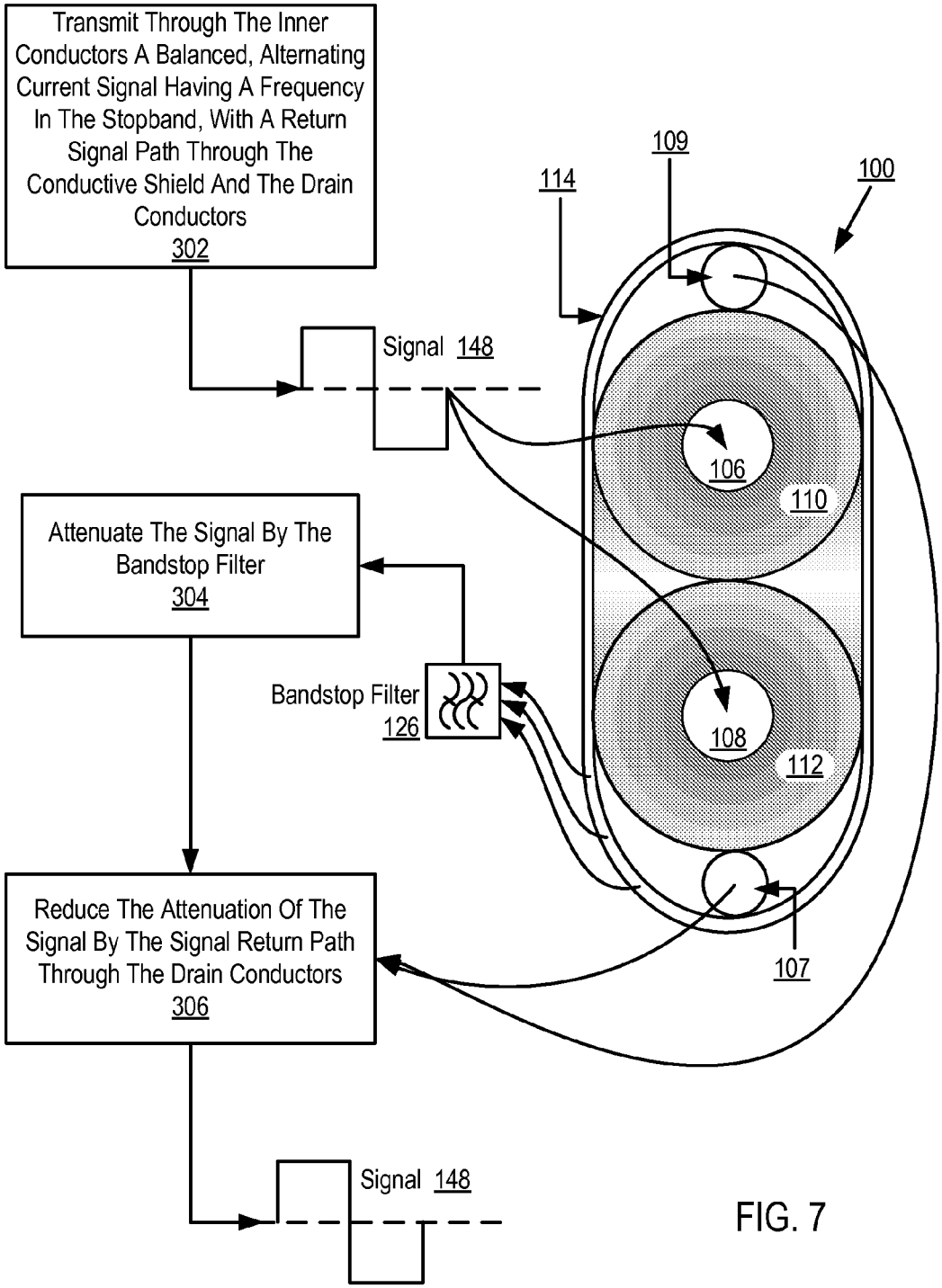
FIG. 7 sets forth a flow chart illustrating an example method of operation for a cable for high speed data communications according to embodiments of the present invention.

For further explanation, FIG. 7 sets forth a flow chart illustrating an example method of operation for a cable for high speed data communications according to embodiments of the present invention. The method of FIG. 7 operates a cable (100) like the one described and illustrated above with reference to FIG. 1, so that FIG. 7 is described with reference not only to FIG. 7 but also to FIG. 1, using reference numbers from both drawings. The method of FIG. 7 operates a cable (100) like the one described and illustrated above with reference to FIG. 1, a cable that includes a first inner conductor (106) enclosed by a first dielectric layer (110) and a second inner conductor (108) enclosed by a second dielectric layer (112), with the inner conductors (106, 108) and the dielectric layers (110, 112) disposed within the cable in parallel with a longitudinal axis (115) of the cable. The cable (100) also includes drain conductors (107, 109) disposed within the cable laterally to the inner conductors (106, 108), adjacent to the dielectric layers (110, 112) along the longitudinal axis (105) of the cable, and within thirty degrees of a horizontal axis (130) through the inner conductors. The cable (100) also includes a conductive shield composed of a strip of overlapping wraps (101, 102, 103) of conductive shield material wrapped in a rotational direction along and about the longitudinal axis (105) around the inner conductors (106, 108), the dielectric layers (110, 112), and the drain conductors (107, 109), where the overlapped (104, 101, 102, 103) wraps of the conductive shield material along the longitudinal axis (105) create a bandstop filter (126) that attenuates signals at frequencies in a stopband.

The method of FIG. 7 includes transmitting (302) through the inner conductors (106, 108) a balanced, alternating current signal (148) having a frequency in the stopband, with a return signal path (124) through the conductive shield (114) and the drain conductors (107, 109), attenuating (204) the signal by the bandstop filter (126), and reducing (306) the attenuation of the signal by the signal return path (124) through the drain conductors (107, 109). The overlapped wraps (101, 102, 103) of the conductive shield (114) create a bandstop filter (126) that attenuates signals at frequencies in a stopband. Such a stopband typically has a center frequency in the range of 5-10 gigahertz. The drain conductors (107, 109) implement uniform current return paths (124) that reduce the attenuation of signals having frequencies in the stopband. The drain conductors (107, 109) provide a uniform characteristic impedance without disruption throughout the entire length of the cable, circumventing an otherwise disruptive effect of the overlapped wraps of the conductive shield material.

It will be understood from the foregoing description that modifications and changes may be made in various embodiments of the present invention without departing from its true spirit. The descriptions in this specification are for purposes of illustration only and are not to be construed in a limiting sense. The scope of the present invention is limited only by the language of the following claims.

What is claimed is:

1. A cable for high speed data communications, the cable comprising:

a first inner conductor enclosed by a first dielectric layer and a second inner conductor enclosed by a second dielectric layer, the inner conductors and the dielectric layers disposed within the cable in parallel with a longitudinal axis of the cable;

a third inner conductor enclosed by a third dielectric layer and a fourth inner conductor enclosed by a fourth dielectric layer, the third and fourth inner conductors and the third and fourth dielectric layers stacked upon the first and second inner conductors and the first and second dielectric layers parallel with and along the longitudinal axis of the cable; and drain conductors disposed within the cable laterally to the third and fourth inner conductors adjacent to the third and fourth dielectric layers along the longitudinal axis of the cable and within thirty degrees of a horizontal axis through the third and fourth inner conductors;

drain conductors disposed within the cable laterally to the inner conductors adjacent to the dielectric layers along the longitudinal axis of the cable and within thirty degrees of a horizontal axis through the inner conductors; and a conductive shield comprising a strip of conductive shield material wrapped in a rotational direction along and about the longitudinal axis around the inner conductors, the dielectric layers, and the drain conductors, including overlapped wraps of the conductive shield material along the longitudinal axis, wherein the conductive shield material is around all four inner conductors, all four dielectric layers, all of the drain conductors, and no other conductive shields.

2. The cable of claim 1 wherein the drain conductors further comprise the conductive wires disposed on the horizontal axis through the inner conductors.

3. The cable of claim 1 wherein the drain conductors are disposed within angles defined by lines through the centers of the inner conductors and a horizontal axis through the inner conductors, the angles so defined being equal to or less than thirty degrees from the horizontal axis.

4. The cable of claim 1 wherein the overlapped wraps of the conductive shield material create a bandstop filter that attenuates signals at frequencies in a stopband characterized by a center frequency in the range of 5-10 gigahertz.

5. The cable of claim 1 wherein:

the overlapped wraps of the conductive shield material create a bandstop filter that attenuates signals at frequencies in a stopband; and the drain conductors comprise uniform current return paths that reduce the attenuation of signals having frequencies in the stopband.

6. The cable of claim 1 wherein:

the overlapped wraps of the conductive shield material create a bandstop filter that attenuates signals at frequencies in a stopband; and the drain conductors provide a uniform characteristic impedance without disruption throughout the entire length of the cable, circumventing an otherwise disruptive effect of the overlapped wraps of the conductive shield material.

7. The cable of claim 1 wherein the cable further comprises a non-conductive layer disposed parallel to the longitudinal axis and enclosing the inner conductors, the dielectric layers, the drain conductors and the conductive shield.

8. A method of operation for a cable for high speed data communications, the cable comprising:

a first inner conductor enclosed by a first dielectric layer and a second inner conductor enclosed by a second dielectric layer, the inner conductors and the dielectric layers disposed within the cable in parallel with a longitudinal axis of the cable;

a third inner conductor enclosed by a third dielectric layer and a fourth inner conductor enclosed by a fourth dielectric layer, the third and fourth inner conductors and the third and fourth dielectric layers stacked upon the first and second inner conductors and the first and second dielectric layers parallel with and along the longitudinal axis of the cable; and drain conductors disposed within the cable laterally to the third and fourth inner conductors adjacent to the third and fourth dielectric layers along the longitudinal axis of the cable and within thirty degrees of a horizontal axis through the third and fourth inner conductors;

drain conductors disposed within the cable laterally to the inner conductors adjacent to the dielectric layers along the longitudinal axis of the cable and within thirty degrees of a horizontal axis through the inner conductors; and a conductive shield comprising a strip of conductive shield material wrapped in a rotational direction along and about the longitudinal axis around the inner conductors, the dielectric layers, and the drain conductors, including overlapped wraps of the conductive shield material along the longitudinal axis that create a bandstop filter that attenuates signals at frequencies in a stopband, wherein the conductive shield material is around all four inner conductors, all four dielectric layers, all of the drain conductors, and no other conductive shields;

the method comprising:

transmitting through the inner conductors a balanced, alternating current signal having a frequency in the stopband, with a return signal path through the conductive shield and the drain conductors;

attenuating the signal by the bandstop filter; and reducing the attenuation of the signal by the signal return path through the drain conductors.

9. The method of claim 8, wherein the drain conductors further comprise the conductive wires disposed on the horizontal axis through the inner conductors.

10. The method of claim 8, wherein the drain conductors further comprise the conductive wires disposed within the angles defined by lines through the centers of the inner conductors and the horizontal axis through the inner conductors, the angles so defined being equal to or less than thirty degrees from the horizontal axis.

11. The method of claim 8, wherein the overlapped wraps of the conductive shield material create a bandstop filter that attenuates signals frequencies in a stopband characterized by a center frequency in the range of 5-10 gigahertz.

12. The method of claim 8, wherein the drain conductors comprise uniform current return paths that reduce the attenuation of signals having frequencies in the stopband.

* * * * *